US012796742B2

(12) United States Patent
Batista et al.

(10) Patent No.: US 12,796,742 B2
(45) **Date of Patent: *Nov. 17, 2026**

(54) AEROSOL-GENERATING DEVICE WITH VISUAL FEEDBACK MEANS

(71) Applicant: Philip Morris Products S.A., Neuchâtel (CH)

(72) Inventors: Rui Nuno Batista, Morges (CH); Ricardo Cali, Mannheim (DE)

(73) Assignee: Philip Morris Products S.A., Neuchâtel (CH)

( * ) Notice: Subject to any disclaimer, the term of this patent is extended or adjusted under 35 U.S.C. 154(b) by 453 days.

This patent is subject to a terminal disclaimer.

(21) Appl. No.: 18/002,395

(22) PCT Filed: Jun. 22, 2021

(86) PCT No.: PCT/EP2021/067035
§ 371 (c)(1),
(2) Date: Dec. 19, 2022

(87) PCT Pub. No.: WO2021/259948
PCT Pub. Date: Dec. 30, 2021

(65) Prior Publication Data

US 2023/0225418 A1 Jul. 20, 2023

(30) Foreign Application Priority Data

Jun. 25, 2020 (EP) ..... 20182257

(51) Int. Cl.
*A24F 40/60* (2020.01)
*A24F 40/40* (2020.01)
(Continued)

(52) U.S. Cl.
CPC ..... *A24F 40/60* (2020.01); *A24F 40/40* (2020.01); *A24F 40/42* (2020.01); *A24F 40/46* (2020.01); *A24F 40/50* (2020.01); *A24F 40/51* (2020.01)

(58) Field of Classification Search
CPC ..... A24F 40/40; A24F 40/50; A24F 40/51; A24F 40/53; A24F 40/60; A24F 40/20;
(Continued)

(56) References Cited

U.S. PATENT DOCUMENTS

2014/0123990 A1 5/2014 Timmermans
2015/0077981 A1 3/2015 Cormack
(Continued)

FOREIGN PATENT DOCUMENTS

AU 2018217237 B2 5/2020
CA 3020139 A1 * 2/2020 ..... A24F 40/53
(Continued)

OTHER PUBLICATIONS

Translation of KR 10-2019-0130914 A (Year: 2019).*
(Continued)

*Primary Examiner* — Michael H. Wilson
*Assistant Examiner* — Michael Patrick Mullen
(74) *Attorney, Agent, or Firm* — Oblon, McClelland, Maier & Neustadt, L.L.P.

(57) ABSTRACT

An aerosol-generating device is provided, including: an elongate housing having a distal end and a proximal end and being configured to receive an aerosol-generating article, the elongate housing defining a heating chamber having an open end at the proximal end of the aerosol-generating device, the heating chamber being configured for insertion of an aerosol-generating article, in which during consumption the proximal end of the aerosol-generating device points towards a consumer, in which the proximal end of the
(Continued)

aerosol-generating device includes a visual feedback means, and in which the visual feedback means surrounds the aerosol generating article, when received in the aerosol-generating device. An aerosol-generating system, and a method of operating an aerosol-generating system, are also provided.

15 Claims, 4 Drawing Sheets

(51) Int. Cl.

| | |
|---|---|
| ***A24F 40/42*** | (2020.01) |
| ***A24F 40/46*** | (2020.01) |
| ***A24F 40/50*** | (2020.01) |
| ***A24F 40/51*** | (2020.01) |

(58) Field of Classification Search
CPC .. A24F 40/42; A61M 15/06; A61M 2205/587
See application file for complete search history.

(56) References Cited

U.S. PATENT DOCUMENTS

| | | | | |
|---|---|---|---|---|
| 2015/0216233 | A1* | 8/2015 | Sears | F21V 33/004 362/230 |
| 2016/0302488 | A1 | 10/2016 | Fernando et al. | |
| 2017/0013876 | A1* | 1/2017 | Schennum | A24F 40/95 |
| 2018/0160738 | A1 | 6/2018 | Verleur et al. | |
| 2019/0200677 | A1* | 7/2019 | Chong | A24D 1/02 |
| 2019/0387799 | A1* | 12/2019 | Reevell | A24F 40/30 |
| 2020/0178608 | A1 | 6/2020 | Fernando et al. | |
| 2020/0383380 | A1* | 12/2020 | Spencer | A24F 40/50 |
| 2021/0046261 | A1* | 2/2021 | Barbaric | A24F 40/65 |
| 2022/0273892 | A1* | 9/2022 | Adam | A61M 15/08 |

FOREIGN PATENT DOCUMENTS

| | | | | | |
|---|---|---|---|---|---|
| CN | 106170215 | A | | 11/2016 | |
| EP | 3 508 084 | A1 | | 7/2019 | |
| GB | 2559683 | A | | 8/2018 | |
| JP | 2019-193609 | A | | 11/2019 | |
| JP | 2020-505073 | A | | 2/2020 | |
| KR | 10-2016-0111902 | A | | 9/2016 | |
| KR | 10-2019-0053498 | A | * | 5/2019 | A24F 47/00 |
| KR | 10-2012851 | B1 | | 8/2019 | |
| KR | 10-2019-0130914 | A | | 11/2019 | |
| RU | 2 682 103 | C2 | | 3/2019 | |

OTHER PUBLICATIONS

Translation of KR 10-2019-0053498 A (Year: 2019).*
International Search Report & Written Opinion mailed on Sep. 24, 2021 in PCT/EP2021/067035 filed on Jun. 22, 2021 (pages).
Japanese Office Action issued Dec. 27, 2023 in Japanese Patent Application No. 2022-578620 (with English translation), 8 pages.
Combined Russian Office Action and Search Report issued Mar. 27, 2023 in Russian Patent Application No. 2023101243/03 (with English Translation), 15 pages.
Korean Office Action issued Jan. 10, 2025 in Korean Patent Application No. 10-2022-704416 with English translation, 10 pgs.
Combined Chinese Office Action and Search Report issued Feb. 28, 2025 in Chinese Patent Application No. 202180039351.1 (with English Translation), 17 pages.
Chinese Notice of Allowance issued Sep. 16, 2025 in corresponding Chinese Patent Application No. 202180039351.1, 4 pages.

* cited by examiner

Fig. 3
Fig. 3A
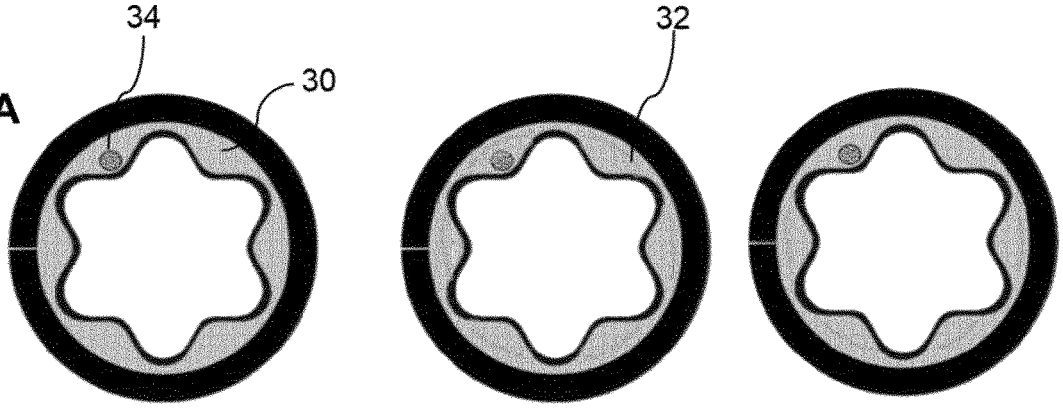
Fig. 3B
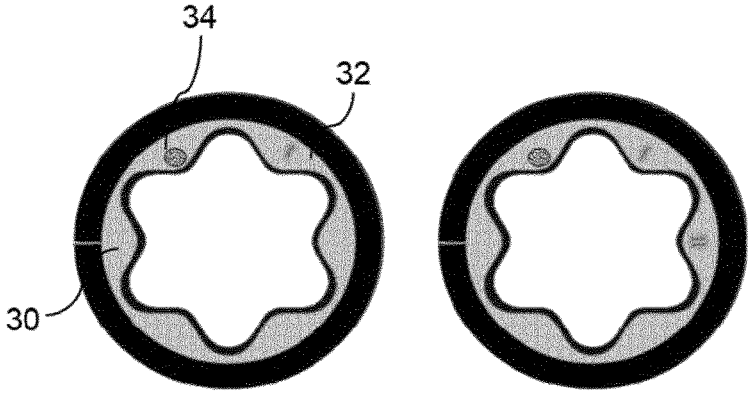

Fig. 4
Fig. 4A
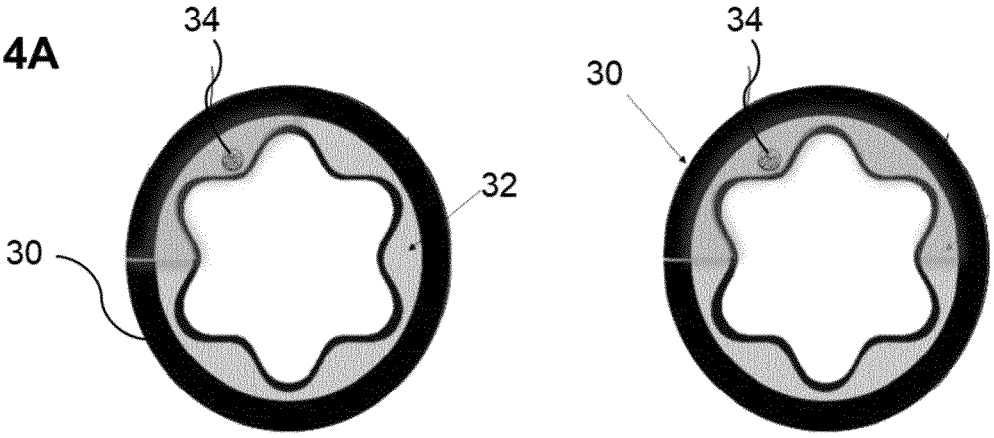
Fig. 4B
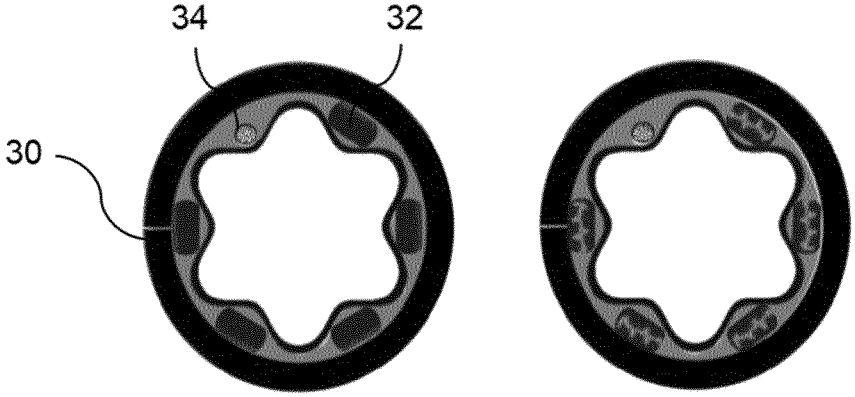

AEROSOL-GENERATING DEVICE WITH VISUAL FEEDBACK MEANS

The present invention relates to an aerosol-generating device comprising visual feedback means provided at the end face of the aerosol generating device that during use points towards the consumer. The present invention also relates to an aerosol-generating system comprising the aerosol-generating device and a removable aerosol-forming article and to a method of operating an aerosol-generating device.

Visual feedback means are frequently used in electronic aerosol-generating devices to visually provide information to the user. Existing aerosol-generating devices comprising different types of displays in their lateral surfaces are known in the art.

It is also known to provide end faces that in use point away from the consumer with visual feedback means. Typically, such visual feedback means are used in order to mimic the glow of a conventional cigarette.

Currently used visual feedback means are provided at positions of the aerosol-generating devices that cannot be easily observed during the user experience. Since such visual feedback means are usually provided at the sides of the housing of the aerosol-generating device, the aerosol-generating device may have to be turned around to be inspected. Such handling may be perceived as cumbersome by the consumers.

It would be desirable to provide an aerosol-generating device having a visual feedback means that can conveniently be checked during the user experience.

It would further be desirable to provide an aerosol-generating device having a visual feedback means that can conveniently be checked before, during and after the user experience and which can convey different types of information.

According to an embodiment of the present invention there is provided an aerosol-generating device comprising an elongate housing having a distal end and a proximal end.

During consumption the proximal end of the aerosol-generating device points towards the consumer. The proximal end of the aerosol-generating device comprises a visual feedback means.

The aerosol-generating device may be configured to receive an aerosol-generating article. The visual feedback means may surround the aerosol generating article in use.

The visual feedback means provided on the proximal end of the aerosol-generating device are readily visible to the user during the user experience. In particular between puffs the user may visually check the indication means without having to turn the aerosol-generating device. In this way handling of the aerosol-generating device is made more convenient.

As used herein, an 'aerosol-generating device' relates to a device that interacts with an aerosol-forming substrate to generate an aerosol. The aerosol-forming substrate may be part of an aerosol-generating article. An aerosol-generating device may be a device that interacts with an aerosol-forming substrate of an aerosol-generating article. An aerosol-generating device may be a holder. The aerosol-generating device may be an electrically heated aerosol-generating device. The aerosol-generating device may comprise a housing, electric circuitry, a power supply, a heating chamber and a heating element. The housing may define a cavity that comprises the heating chamber having an open end at the proximal end of the aerosol-generating device, and the heating element. The heating chamber may be configured for insertion of an aerosol-generating article. The heating element may be part of the aerosol-generating article.

The aerosol-generating device is preferably a portable or handheld device that is comfortable to hold between the fingers of a single hand. The device may be substantially cylindrical in shape and may have a length of between 30 and 150 millimetres. The maximum diameter of the device is preferably between 5 and 30 millimetres.

The housing of the aerosol-generating device may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

The housing may comprise a mouthpiece. The housing may comprise at least one air inlet. The housing may comprise more than one air inlet. The mouthpiece may comprise at least one air inlet and at least one air outlet. The mouthpiece may comprise more than one air inlet. One or more of the air inlets may reduce the temperature of the aerosol before it is delivered to a user and may reduce the concentration of the aerosol before it is delivered to a user.

As used herein, the term 'mouthpiece' refers to a portion of an aerosol-generating device that during a puff is closest to the user's mouth.

The aerosol-generating device may include a sensor to activate the aerosol-generating device. The aerosol-generating device may include a user interface to activate the aerosol-generating device, for example a button to initiate heating of the aerosol-generating device or display to indicate a state of the aerosol-generating device or of the aerosol-forming substrate.

As used herein, the term 'user experience' refers to the act of consuming an aerosol-generating article. A user experience may include one or more consecutive puffs. The user experience also includes the time period in between puffs.

The visual feedback means of the aerosol-generating device may comprise a display device that is based on light emitting diodes (LED), micro LEDs, organic LEDs (OLED) devices or LCD technology. The display device of the visual feedback means may be capable of displaying monochromatic or coloured light. The display device of the visual feedback means may be capable of displaying symbols, signs, letters or numbers. As light source of the aerosol-generating device any known light source with low power consumption may be used. Suitable light sources include light emitting diodes (LED), micro LEDs or organic LEDs (OLED) devices.

The visual feedback means may have any suitable shape. The visual feedback means may essentially extend over the complete proximal end face of the aerosol-generating device. The visual feedback means may be ring shaped and may be provided at the proximal end face of the aerosol-generating device.

The visual feedback means may comprise segmented display devices. The visual feedback means may comprise a plurality of display devices.

The visual feedback means may be arranged at the proximal end of the aerosol-generating device in such way that they may indicate useful information to the user. The information conveyed by the visual feedback means may pertain to the various operation status of the aerosol-generation device. The visual feedback means may also be used to indicate a progress of a specific operation or information regarding the user experience.

The visual feedback means may include a display device that is capable of displaying multi-chromatic light. The various colours of this display device can be used to indicate the operation status of the aerosol-generating device. A first colour can be used to indicate readiness of the aerosol-generating device to be used. A second colour can be used to indicate that the aerosol-generating device is in the heat-up phase. A third colour can be used to indicate that the aerosol-generating device is fully heated and ready for consumption. A fourth colour can be used to indicate that the aerosol-generating article is fully consumed.

Display devices that are capable of generating multi coloured light may have low power consumption. These display devices may have low power consumption. The addition of a display device with low power consumption advantageously puts only a very small load on the power source of an existing aerosol-generating device, preferably with only very limited effect on the design of the existing power source. This is particularly advantageous for portable devices in which capacity of the power source is limited and excess power consumption is to be avoided.

The visual feedback means may also be operated in a way as to indicate the progress of an operation of the aerosol-generating device. Such progress may relate to the progress of the heat-up phase of the aerosol-generating device. The visual feedback means may be used to indicate the elapsed time since the last puff. The visual feedback means may also be used to indicate the elapsed time since the last user experience.

In order to indicate a progress of an operation of the aerosol-generating device the display device of the visual feedback means may be operated in pulsating mode, may be operated to change the colour tone or may be operated to change the light intensity. If the visual feedback means comprises a segmented display device or a plurality of individual display devices, segmented lighting of individual sections or display devices may be used to indicate progress of an operation.

Displaying a progress of an operation to the user may further enhance communication between the aerosol-generating device and the users. The user obtains additional information on the course of the user experience and overall handling of the aerosol-generating device may be improved.

The visual feedback means may also be used in a flashing mode. In flashing mode the visual feedback means are controlled to repeatedly emit a short burst of light. Intensity of the emitted light may be higher than in pulsating mode. A flashing mode may be suitable to indicate a warning to the user. A warning signal may for example be used to indicate overheating of the aerosol-generating device. One or more of the display devices of the visual feedback means may be used in flashing mode.

The visual feedback means may also be controlled to display animated fade in and fade out of shapes or symbols.

The display device of the visual feedback means may also comprise a multi-pixel display device. Such display devices may be photorealistic displays. Such display devices may be based on Micro LED technology. Due to the limited size of such display, the displayed content is preferably of reduced complexity. For example, such multi pixel display may show a pulsing line, which may be used to indicate the strength of the last puff.

The display size of such multi-pixel displays depends on the size of the available surface at the proximal end of the aerosol-generating device. A multi-pixel display device may have a size of up to 1 square centimetre. A multi-pixel display device may have a size of between 0.1 to 0.2 square centimetres. A multi-pixel display device may have a size of about 8.8 millimetres times 1.5 millimetres. Such multi-pixel display device would have a size of about 0.13 square centimetres. Such multi-pixel display device may comprise 600 times 200 pixels with a pixel pitch of about 0.0146 millimetres.

The various indication modes may be combined with each other. The user may also be able to customize the indication modes. Customization may be done by connecting the aerosol generating device to a personal computer, a smart phone or any other suitable input device. By customizing the indication means, the user may choose the indication modes of the visual feedback means. For example, the user may select colours, pulsating or flashing frequencies, colour transitions of the display devices. Position, size, colour and brightness of any shapes or symbols displayed by the visual feedback means may be customized. When a multi-pixel display is used, the user may set up the displayed content by use of the input device.

The aerosol-generating device may comprise a power source and a control unit. The visual feedback means may be electrically connected to the power source and the control unit of the aerosol-generating device. The control unit may be used to control the overall operation of the aerosol-generating device. The control unit may in particular be used to control the visual feedback means. The control unit may control the visual feedback means based on the status or the progress of operations of the aerosol-generating device. The control unit may adjust pulsating frequency, flashing frequency, colour tone, light intensity of the display device.

The control unit may be connected to the heating element of the aerosol-generating device. The control unit may control the visual feedback means based on the status of the heating element of the aerosol-generating device.

The aerosol-generating device may include a sensor to activate the aerosol-generating device. The aerosol-generating device may include a user interface to activate the aerosol-generating device, for example a button to initiate heating of the aerosol-generating device or display to indicate a state of the aerosol-generating device or of the aerosol-forming substrate. The control unit may be connected to such button or a corresponding activation sensor. The control unit may control the visual feedback means based on the activation status of the aerosol-generating device.

The proximal end of the aerosol-generating device may comprise a proximity sensor. The proximity sensor may be used to detect that the proximal end of the aerosol-generating device is in proximity to the consumer, for example the proximity of the proximal end of the aerosol generating device to the consumer's mouth. The proximity sensor may be in electrical connection with the control unit of the aerosol-generating device. The proximity sensor may be a photocell. The control unit may be configured to control the visual feedback means based on signals received from the proximity sensor.

During a puff the proximal end of the aerosol-generating device may be so close to the user's mouth that the user cannot observe the visual feedback means with the eyes. In such situation visibility of the visual feedback means is not crucial anymore, and the control unit may be used to dim or even to switch off the display devices of the visual feedback means. In this way overall energy consumption of the visual feedback means may be reduced.

The aerosol-generating device may comprise a light sensor in electrical connection with the control unit of the aerosol-generating device.

The light sensor may be used to detect the lighting conditions of the ambient environment. The light sensor may be provided anywhere at the outside of the housing of the aerosol-generating device. The light sensor may be advantageously provided at a location at the aerosol-generating device that is not obstructed by the hand of the user during normal handling of the aerosol-generating device. The light sensor may be in electrical connection with the control unit of the aerosol-generating device. The control unit may be configured to control the visual feedback means based on signals received from the light sensor.

At night or in an environment with low lighting conditions, the illumination intensity of the display devices of the visual feedback means may be reduced. Reduction of illumination intensity of the display devices of the visual feedback means may reduce the overall power consumption of the aerosol-generating device.

The housing of the aerosol-generating device may comprise a top cover that may be mounted to the proximal end of the housing of the aerosol-generating device. The top cover may have a proximal end face that faces to the user during consumption. The proximal end face of the top cover comprises the above described visual feedback means.

The top cover may be detachable from the housing of the aerosol-generating device. The detachable top cover may be essentially ring shaped and may define a central opening. The central opening of the top cover may define the opening of the heating chamber. The detachable top cover may have an outer cross-section that generally corresponds to the outer cross-section of the housing of the aerosol-generating device. The opening of the top cover may a have a circular profile. The opening of the top cover may also have an ornamental, non-circular profile. Preferably, the opening of the top cover is large enough to allow insertion of an aerosol-generating article there through and into the heating chamber of the aerosol-generating device.

By providing the visual feedback means on a detachable top cover, the user may be able to customize the aerosol-generating device. The user may purchase top covers having different visual feedback means and may exchange top covers based on personal preference.

The detachable top cover may be made from the same material as the housing of the aerosol-generating device. The detachable top cover may be made from a metal or polymeric compound. The detachable top cover may be made from a polyurethane based compound.

The detachable top cover may comprise connection means for reversibly connecting the top cover to the housing of the aerosol-generating device. The connection means may be a screw connection, a form fitting connection, or a bayonet type connection. These kinds of connection means do not require application of increased force and can be readily utilised by users.

The detachable top cover may comprise electrical connection means facilitating an electrical connection between the visual feedback means and the control unit of the aerosol-generating device. Preferably the detachable top cover is configured such that the electrical connection means are automatically connected when the detachable top cover is correctly mounted to the housing of the aerosol-generating device. For this purpose the detachable top cover may be provided with one or more stoppers that limit rotation of the top cover with respect to the housing.

The present invention is also directed to an aerosol-generating system comprising an aerosol-generating device as described above and an aerosol-forming article configured to be inserted into the heating chamber of the aerosol-generating device.

The present invention is also directed to a method of operating an aerosol-generating system comprising an aerosol-generating device with a proximity sensor located at its proximal end. The method includes that the control unit of the aerosol-generating device controls the visual feedback means in dependence of the signal received from the proximity sensor.

As discussed above, power management of an aerosol-generating device is crucial for optimum and reliable performance. This is especially true for aerosol-generating devices using rechargeable power sources having limited power capacity.

The visual feedback means may enhance the user experience, but may at the same time consume electrical power. It is thus desirable that the amount of energy consumed by the visual feedback means is as low as possible. For this purpose, the control unit may be configured to energize certain features of the aerosol-generating device only when these features contribute to enhancing the user experience.

During a puff the visual feedback means are out of the view field of the user. Thus, at this moment the visual feedback means do not have to be illuminated, or may at least be illuminated at a lower level, only.

Therefore, the control unit of the aerosol-generating device may be configured to reduce the light intensity of the visual feedback means when the proximity sensor detects proximity to the consumer's mouth.

In embodiments in which the aerosol-generating device comprises a light sensor, the control unit of the aerosol-generating device may be configured to adjust the light intensity of the visual feedback means based on signals received from the light sensor. In this way the control unit may adjust the light intensity of the visual feedback means to a reduced level, when the light sensor detects that the aerosol-generating device is operated in darkness or at low lighting conditions.

Below, there is provided a non-exhaustive list of non-limiting examples. Any one or more of the features of these examples may be combined with any one or more features of another example, embodiment, or aspect described herein.

Example 1: Aerosol-generating device comprising an elongate housing having a distal end and a proximal end, wherein during consumption the proximal end of the aerosol-generating device points towards the consumer, and wherein the proximal end of the aerosol-generating device comprises a visual feedback means.

Example 2: Aerosol-generating device according to example 1, wherein the visual feedback means comprise a display device that is based on LED, micro LED, OLED or LCD technology.

Example 3: Aerosol-generating device according to any preceding example, wherein the display device of the visual feedback means is capable of displaying monochromatic or coloured light.

Example 4: Aerosol-generating device according to any preceding example, wherein the display device of the visual feedback means is a multi-pixel display device.

Example 5: Aerosol-generating device according to any preceding example, wherein the visual feedback means comprises a plurality of display devices.

Example 6: Aerosol-generating device according to any preceding example, wherein the visual feedback means comprises a display device with a plurality of segments.

Example 7: Aerosol-generating device according to example 6, wherein the segments of the display devices are configured to form a segmented wheel.

Example 8: Aerosol-generating device according to any preceding example, wherein the visual display device may be configured to display letters, numbers or shapes.

Example 9: Aerosol-generating device according to any preceding example, wherein the aerosol-generating device comprises a power source and a control unit, and wherein the visual feedback means is electrically connected to the power source and the control unit of the aerosol-generating device.

Example 10: Aerosol-generating device according to any preceding example, wherein the proximal end of the aerosol-generating device comprises a proximity sensor for detecting proximity to the consumers mouth, the proximity sensor being in electrical connection with the control unit of the aerosol-generating device.

Example 11: Aerosol-generating device according to any preceding example, wherein the aerosol-generating device comprises a light sensor, the light sensor being in electrical connection with the control unit of the aerosol-generating device.

Example 12: Aerosol-generating device according to example 10 or 11, wherein the control unit is configured to control the visual feedback means based on signals received from the proximity sensor or the light sensor.

Example 13: Aerosol-generating device according to any preceding example, wherein the housing of the aerosol-generating device defines a heating chamber having an open end at the proximal end of the aerosol-generating device, the heating chamber being configured for insertion of an aerosol-generating article.

Example 14: Aerosol-generating device according to any preceding example wherein the housing has a detachable top cover comprising electrical connection means facilitating an electrical connection between the visual feedback means and the control unit of the aerosol-generating device, upon connection of the detachable top cover to the housing of the aerosol-generating device.

Example 15: Aerosol-generating system comprising an aerosol-generating device according to any preceding example, and an aerosol-forming article configured to be inserted into the heating chamber of the aerosol-generating device.

Example 16: Method of operating an aerosol-generating system according to example O, wherein the control unit of the aerosol-generating device controls the visual feedback means in dependence of the signal received from the proximity sensor.

Example 17: Method according to example 16, wherein the control unit of the aerosol-generating device reduces the light intensity of the visual feedback means when the proximity sensor detects proximity to the consumers mouth.

Example 18: Method according to example 16 or 17, wherein the aerosol-generating device comprises a light sensor, the light sensor being in electrical connection with the control unit of the aerosol-generating device, and wherein the control unit of the aerosol-generating device adjusts the light intensity of the visual feedback means based on signals received from the light sensor.

Features described in relation to one embodiment may equally be applied to other embodiments of the invention.

The invention will be further described, by way of example only, with reference to the accompanying drawings in which:

FIG. 3 shows various display modes of the visual feedback means; and

FIG. 4 shows further display modes of the visual feedback means.

Figure 1:
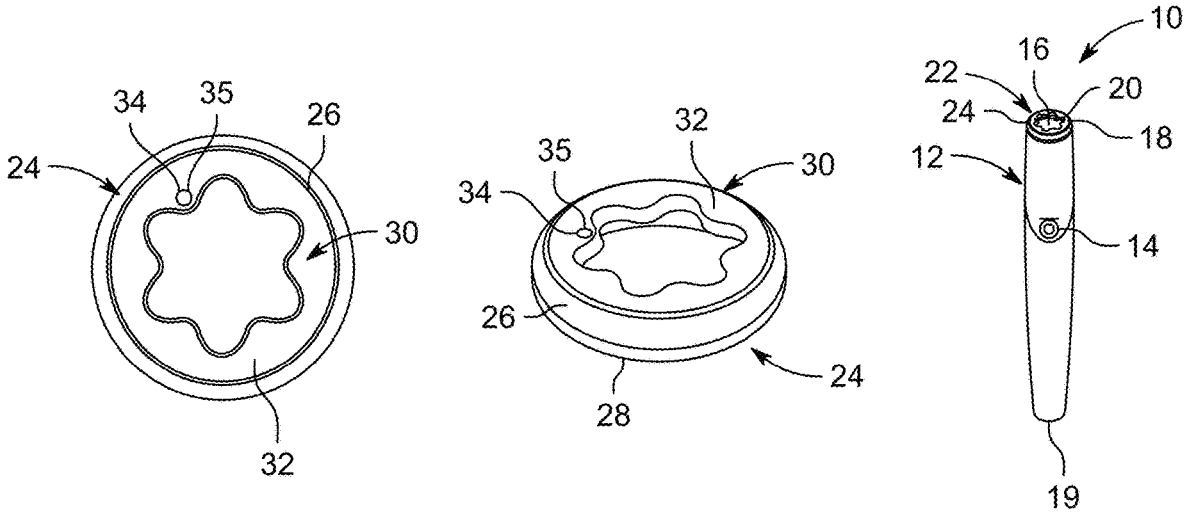
FIG. 1 shows an aerosol-generating device.

FIG. 1 shows an aerosol-generating device 10 that is configured to cooperate with an aerosol-generating article to generate an aerosol. The aerosol-generating device 10 is an electrically heated aerosol-generating device comprising an elongate housing 12 with a power switch 14, a control unit (not shown), a power supply (not shown) and a heating chamber 16. The elongate housing 12 has a proximal end 18 and a distal end 19. The elongate housing 12 defines a cavity 20 that comprises the heating chamber 16 having an open end 22 at the proximal end 18 of the aerosol-generating device 10. The heating chamber 16 is configured for insertion of an aerosol-generating article (not shown).

At the proximal end 18 of the aerosol-generating device 10 there is provided a detachable top cover 24. FIGS. 1A and 1B show an enlarged plan view and a perspective view of the detachable top cover 24. The detachable top cover comprises a generally ring-shaped body 26. The body 26 is made from polyurethane. The body 26 has a circular outer cross-section that corresponds to the outer cross-section of the housing 12 of the aerosol-generating device 10.

At the bottom of the detachable top cover 24 there is provided a screw connection 28 via which the top cover 24 can be reversibly connected to the housing 12 of the aerosol-generating device 10.

The top cover 24 further comprises a visual feedback means 30. In the embodiment of FIG. 1 the visual feedback means is a single ring shaped display device 32 that extends over the proximal end face of the top cover 24. The ring shaped display device 32 is configured to emit visible light with variable colour.

The control unit is configured to control the display device 32 in dependence of the status and the progress of specific operations of the aerosol-generating device 10. When the user switches on the aerosol-generating device 10 via power switch 14, the display device 32 is controlled to emit white light to indicate activation of the aerosol-generating device 10. During the heat-up phase the display device 32 emits red light. When the aerosol-generating device 10 is heated up and is ready for generating an aerosol, the display device 32 is controlled to emit green light. As an indicator for the end of consumption the display device 32 is controlled to emit blue light. Since in use the proximal end 18 of the aerosol-generating device 10 points towards the user, the user may readily observe the changing colours of the display device 32 and obtain information on the status of the aerosol-generating device 10.

During a user experience, the user inserts an aerosol-generating article into the heating chamber 16 of the aerosol-generating device 10. The aerosol-generating article has a mouthpiece portion that protrudes from the heating chamber 16.

During a puff, the proximal end 18 of the aerosol-generating device 10 is out of the view field of the user. Thus, in this situation the visual feedback means 30 cannot be observed and may therefore be switched off.

For this purpose, the top cover 24 further comprises a proximity sensor 34 and/or a light sensor 35. The proximity sensor 34 is configured to detect proximity to the user's mouth. The control unit adjusts the brightness of the display device 32 based on signals received from the light sensor 35 such as to ensure good readability of the display. During a puff, when the proximity sensor 34 detects proximity to the user's face, the control unit receives corresponding signals from the proximity sensor 34 and dims the brightness of the display device 32 to reduce power consumption.

Figure 2:
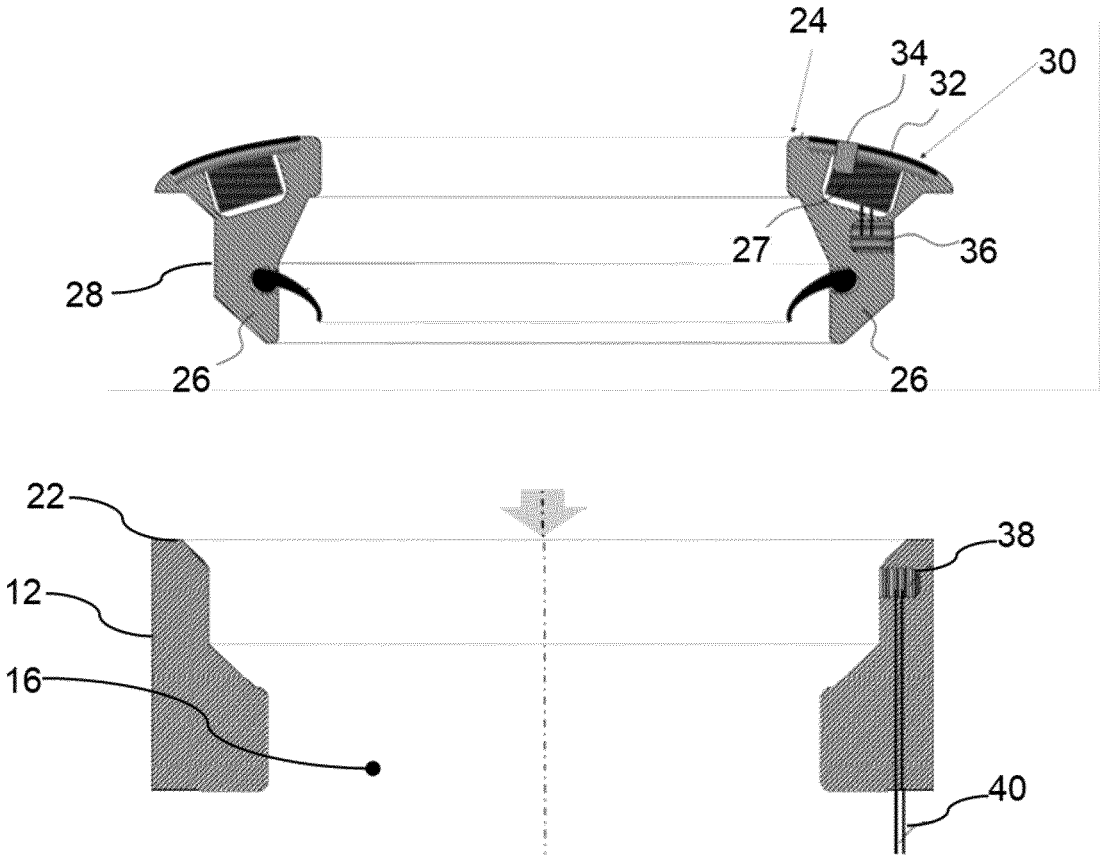
FIG. 2 shows a cross-section of the proximal end of an aerosol-generating device.

In FIG. 2 a cross-sectional view of a top cover 24 removed from the open end 22 of the heating chamber 16 at the proximal end 18 of the housing 12 of the aerosol-generating device 10. The body 26 of the top cover 24 comprises a cavity 27 in which the display housing is located. Also the proximity sensor 34 is provided in the cavity 27. The display device 32 and the proximity sensor 34 are wired to the electrical terminal 36 of the detachable top cover 24.

At the lower lateral sides of the body 26 of the detachable cover 24 again a threading 28 is provided for connecting the top cover 24 to the open end 22 of the housing 12 of the aerosol-generating device 10.

At the proximal end 18 of the housing also a further electrical terminal 38 is provided. When the top cover 24 is fully mounted to the housing 12, an electrical connection is established between the electrical terminal 36 of the top cover 24 and the electrical terminal 38 of the housing 12. Over wiring 40 an electrical connection between the control unit and the display device 32 is enabled.

In FIG. 3 various possibilities of how to display information by the visual feedback means 30 are depicted. In FIG. 3A, the visual feedback means 30 comprises a display device 32 with six segments. The segments are configured as circular segments that form in combination a segmented wheel. When the aerosol-generating device 10 is deactivated, the display device 32 is switched off as depicted in the left view of FIG. 3A. When the aerosol-generating device 10 is activated, the display device 32 is switched on and all segments of the segmented wheel are illuminated as depicted in the middle view of FIG. 3A. When the aerosol-generating device 10 performs an action, such as heating up, this is indicated by consecutively illuminating the six segments, animating a turning segmented wheel.

The visual feedback means 30 may also be configured for displaying shapes or letters on the display device 32. In the left view of FIG. 3B the display shows a "I" to indicate that one puff has been completed during the user experience. In the right view of FIG. 3B the display shows a "I" and a "II" to indicate that two puffs have been completed during the user experience. Thus, letters, numbers or other shapes may be used as puff count.

In FIG. 4 further possibilities of how to display information by the visual feedback means 30 are depicted. In FIG. 4A, the visual feedback means 30 comprises a display device 32 with four segments. Again only a part of the segments may be lit, so as to indicate progress of an operation. In the two views of FIG. 4A one and two quarters of the display are illuminated, respectively. The visual feedback means 30 thereby indicate that 25 percent and 50 percent of an operation such as heating-up the aerosol-generating device 10 is completed.

In FIG. 4B a further embodiment of the present invention is depicted. The visual feedback means 30 comprise five photorealistic display devices 32 that are each based on micro LED technology. The display devices 32 have display sections that are distributed over the circumference of the ring shaped end face of the aerosol-generating device 10. The display devices 32 are capable of displaying more complex patterns. In the depicted embodiment the display devices 32 show each a pulsing line, to indicate the strength of the previous puff.

A user is able to customize the information that is to be displayed and the appearance of the information to be displayed by a second device, for example a smartphone. For this purpose the smartphone is to be connected with the aerosol-generating device 10. Such connection can be established via an interface cable or via a wireless connection.

The invention claimed is:

1. An aerosol-generating device, comprising:

an elongate housing having a distal end and a proximal end and being configured to receive an aerosol-generating article, wherein the elongate housing defines a heating chamber having an open end at the proximal end of the aerosol-generating device, the heating chamber being configured for insertion of the aerosol-generating article, wherein during consumption the proximal end of the aerosol-generating device points towards a consumer, wherein the proximal end of the aerosol-generating device comprises a visual feedback means, wherein the visual feedback means surrounds the aerosol generating article, when received in the aerosol-generating device, wherein the visual feedback means is ring shaped and is provided at a proximal end face of the proximal end of the aerosol-generating device, wherein the visual feedback means comprises a display device with a plurality of segments, wherein the segments of the display device are configured to form a segmented wheel, wherein the segments are configured to be consecutively illuminated, wherein the display device is based on LED, micro LED, OLED, or LCD technology, and wherein each of the segments of the display device is configured to show a pulsing line to indicate a strength of a previous puff.

2. The aerosol-generating device according to claim 1, wherein the display device of the visual feedback means is configured to display monochromatic or colored light.

3. The aerosol-generating device according to claim 1, wherein the display device of the visual feedback means is a multi-pixel display device.

4. The aerosol-generating device according to claim 1, wherein the visual feedback means comprises a plurality of the display devices.

5. The aerosol-generating device according to claim 1, further comprising a power source and a control unit, wherein the visual feedback means is electrically connected to the power source and the control unit.

6. The aerosol-generating device according to claim 5, wherein the proximal end of the aerosol-generating device comprises a proximity sensor configured to detect proximity to a mouth of the consumer, the proximity sensor being in electrical connection with the control unit of the aerosol-generating device.

7. The aerosol-generating device according to claim 6, wherein the control unit is configured to control the visual feedback means based on signals received from the proximity sensor.

8. The aerosol-generating device according to claim 6, wherein the control unit is configured to reduce a brightness of the display device in response to a signal received from the proximity sensor detecting a proximity of a face of a user.

9. The aerosol-generating device according to claim 5, further comprising a light sensor, the light sensor being in electrical connection with the control unit of the aerosol-generating device.

10. The aerosol-generating device according to claim 9, wherein the control unit is configured to control the visual feedback means based on signals received from the light sensor.

11. The aerosol-generating device according to claim 1, wherein the housing has a detachable top cover comprising electrical connection means facilitating an electrical connection between the visual feedback means and a control unit of the aerosol-generating device, upon connection of the detachable top cover to the housing of the aerosol-generating device.

12. An aerosol-generating system, comprising the aerosol-generating device according to claim 1, and the aerosol-generating article configured to be inserted into the heating chamber of the aerosol-generating device.

13. A method of operating the aerosol-generating system according to claim 12, wherein the proximal end of the aerosol-generating device comprises a proximity sensor configured to detect proximity to a mouth of the consumer, the proximity sensor being in electrical connection with a control unit of the aerosol-generating device, and wherein the control unit of the aerosol-generating device controls the visual feedback means in dependence on a signal received from the proximity sensor.

14. The method according to claim 13, wherein the control unit of the aerosol-generating device reduces the light intensity of the visual feedback means when the proximity sensor detects proximity to the mouth of the consumer.

15. The method according to claim 13, wherein the aerosol-generating device comprises a light sensor, the light sensor being in electrical connection with the control unit of the aerosol-generating device, and wherein the control unit of the aerosol-generating device adjusts the light intensity of the visual feedback means based on signals received from the light sensor.

* * * * *